US011844430B2

(12) United States Patent
Schenker et al.

(10) Patent No.: US 11,844,430 B2
(45) Date of Patent: Dec. 19, 2023

(54) CONFIGURABLE LITERATURE ORGANIZER

(71) Applicant: ADVANTUS, CORP., Jacksonville, FL (US)

(72) Inventors: David A. Schenker, Cedarburg, WI (US); Chris Pitzo, Pewaukee, WI (US)

(73) Assignee: Advantus, Corp., Jacksonville, FL (US)

( * ) Notice: Subject to any disclaimer, the term of this patent is extended or adjusted under 35 U.S.C. 154(b) by 256 days.

(21) Appl. No.: 17/226,236

(22) Filed: Apr. 9, 2021

(65) Prior Publication Data

US 2022/0322826 A1 Oct. 13, 2022

(51) Int. Cl.
*A47B 87/02* (2006.01)

(52) U.S. Cl.
CPC ..... *A47B 87/0269* (2013.01); *A47B 87/0207* (2013.01); *A47B 87/0261* (2013.01)

(58) Field of Classification Search
CPC ..... A47B 87/0269; A47B 87/0261; A47B 87/0207
See application file for complete search history.

(56) References Cited

U.S. PATENT DOCUMENTS 1,116,304 A * 11/1914 Lundstrom ..... A47B 87/02 312/108
2,482,174 A * 9/1949 Hake ..... A47B 87/02 24/605
2,684,766 A * 7/1954 Blom ..... B65D 21/048 206/499
3,003,839 A * 10/1961 Bloom ..... A47B 87/0284 312/111
3,401,993 A * 9/1968 Fenkel ..... A47B 87/02 206/509
3,424,334 A * 1/1969 Goltz ..... B65D 21/0202 220/23.6
3,478,892 A * 11/1969 Lockwood ..... A47B 87/0269 211/126.2
3,480,150 A * 11/1969 Evans ..... A47B 87/0269 211/11
3,534,866 A * 10/1970 Asenbauer ..... A47B 87/0269 211/126.2

(Continued)

FOREIGN PATENT DOCUMENTS

DE 2306357 A1 * 8/1974
DE 3310889 A1 * 10/1983

(Continued)

*Primary Examiner* — Stanton L Krycinski
(74) *Attorney, Agent, or Firm* — Andrus Intellectual Property Law, LLP

(57) ABSTRACT

A configurable literature organizer includes a first tray having a plurality of first connectors, a plurality of second connectors, a top, a bottom, and a pair of opposing sides and a second tray with a plurality of first connectors and a plurality of second connectors. One of the first connector of the plurality of first connectors of the second tray is mated with one second connector of the plurality of the second connectors of the first tray and one second connector of the plurality of second connectors of the second tray is mated with one first connector of the plurality of the first connectors of the first tray to thereby couple the second tray to one of the top, the bottom, or one side of the opposing sides.

17 Claims, 14 Drawing Sheets

(56) References Cited

U.S. PATENT DOCUMENTS 3,552,579 A * 1/1971 Simon ..... A47B 87/02 24/336
3,644,008 A * 2/1972 Overby ..... A47B 87/0253 312/107
3,918,781 A * 11/1975 Paris ..... A47B 87/0207 312/334.44
3,999,818 A * 12/1976 Schankler ..... B65D 21/0204 312/107
4,074,810 A * 2/1978 Juergens ..... B42F 7/12 211/11
4,760,921 A * 8/1988 Licari ..... A47B 87/0269 206/505
4,785,939 A * 11/1988 Huerto ..... B42F 7/12 211/11
4,852,749 A * 8/1989 Fernandez ..... A47J 36/2405 211/126.2
4,919,296 A * 4/1990 Kirsh ..... B65D 21/0204 220/737
4,988,003 A * 1/1991 Spitzer ..... A47B 87/0207 220/23.6
5,137,340 A * 8/1992 Cugley ..... A47B 87/02 312/234.5
5,190,156 A * 3/1993 Conaway ..... B65D 21/048 206/509
5,191,983 A * 3/1993 Hardy ..... A47B 87/00 211/41.12
5,318,182 A * 6/1994 Thorud ..... B65D 1/34 206/509
5,325,966 A * 7/1994 Chang ..... B65D 21/02 206/349
5,399,006 A * 3/1995 Murazumi ..... A61B 50/10 312/109
5,492,399 A * 2/1996 Tillack ..... A47B 87/0253 312/111
5,630,658 A * 5/1997 Jeter ..... A47B 87/02 206/509
5,667,287 A * 9/1997 Gunning ..... A47B 81/068 312/334.6
5,685,439 A * 11/1997 Luenser ..... A47F 5/08 211/183
5,865,324 A * 2/1999 Jay ..... A47F 1/12 211/74
5,934,466 A * 8/1999 Loeffler ..... B65D 21/0209 220/4.27
6,007,167 A * 12/1999 Cohen ..... A47B 87/005 211/40
6,216,894 B1 * 4/2001 Hendricks ..... A47B 63/00 312/111
6,749,070 B2 * 6/2004 Corbett, Jr. ..... H05K 5/0021 211/188
8,037,833 B2 * 10/2011 Hardy ..... B62B 1/26 211/133.1
8,360,255 B2 * 1/2013 Chen ..... A47B 43/02 211/188
9,101,212 B2 * 8/2015 De Roeck ..... A47B 87/0284
9,526,333 B1 * 12/2016 Nielson ..... A47B 87/0292
9,676,518 B2 * 6/2017 Shamp ..... B65D 21/048
D870,457 S * 12/2019 Austin ..... D3/313
11,470,988 B2 * 10/2022 Sharon ..... B65D 5/52
11,589,697 B2 * 2/2023 Foley ..... B65D 21/0215
2002/0125799 A1 * 9/2002 Landsberger ..... A47B 87/02 312/263
2005/0236348 A1 * 10/2005 Killinger ..... B42F 7/12 211/126.7
2011/0240578 A1 * 10/2011 Chuang ..... A47B 87/0269 211/126.7
2016/0145002 A1 * 5/2016 Hsu ..... B65D 21/0212 206/518
2022/0250794 A1 * 8/2022 Schenker ..... B65D 21/0204

FOREIGN PATENT DOCUMENTS

EP 0512930 A1 * 11/1992
EP 0664980 A1 * 8/1995
EP 1563965 A1 * 8/2005 ..... A47B 87/0207
FR 2425823 A1 * 12/1979
GB 402604 A * 12/1933
GB 1422091 A * 1/1976 ..... A47B 87/0269
GB 2270067 A * 3/1994 ..... A47B 87/0269
GB 2488143 A * 8/2012 ..... A47F 5/10
KR 200410763 Y1 * 3/2006
WO 84/03484 9/1984

* cited by examiner

CONFIGURABLE LITERATURE ORGANIZER

FIELD

The present disclosure relates to literature organizers. More specifically, the present disclosure related to literature organizers formed with reconfigurable components, such as trays, that can be connected and disconnected from each other depending on the desired use.

BACKGROUND

Literature organizers are used to organize objects such as a letters, folders, and office supplies. Users, such as office workers, students, and home organizers often place such organizers on desks, or other horizontal surfaces, such that objects can be stored therein. Known literature organizers often have fixed sizes and shapes, and accordingly, the user must buy a specific organizer that fits their needs and fits on their desk or other work surface. When the needs of the user changes or when the desk space of the user changes, the user typically purchases another organizer to fit the new needs. Accordingly, in certain examples, it may be advantageous for the literature organizer to adapt to the changing needs of the user.

The inventors of the present application endeavored to develop literature organizers formed with reconfigurable components such that the organizer can be adapted to each new application. Accordingly, the inventors developed organizers described herein below.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a literature organizer includes a first tray having a plurality of first connectors, a plurality of second connectors, a top, a bottom, and a pair of opposing sides and a second tray with a plurality of first connectors and a plurality of second connectors. One first connector of the plurality of first connectors of the second tray is mated with one second connector of the plurality of the second connectors of the first tray and one second connector of the plurality of second connectors of the second tray is mated with one first connector of the plurality of the first connectors of the first tray to thereby couple the second tray to one of the top, the bottom, or one side of the opposing sides.

In certain examples, a literature organizer includes a first tray having a first sidewall defines a first side of the first tray and has pair of first connectors extending from a top surface. A second sidewall defines a second side of the first tray and has a pair of second connectors extending from a top surface. A base panel extends between the first sidewall and the second sidewall and has a pair of second connectors near the first side of the first tray and a pair of first connectors near the second side of the second tray. A second tray includes a first sidewall with a pair of first connectors extending from a top surface. The first sidewall defines a first side of the second tray. A second sidewall has a pair of second connectors extending from a top surface. The second sidewall defines a second side of the second tray. A base panel extends between the first sidewall and the second sidewall. The base panel has a pair of second connectors near the first side of the second tray and a pair of first connectors near the second side of the second tray. The first connectors along the base panel of the second tray engage with the second connectors along the second sidewall of the first tray and the second connectors along the base panel of the second tray engage with the first connectors along the first sidewall of the first tray to thereby couple the second tray to the first tray in a stacked orientation.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
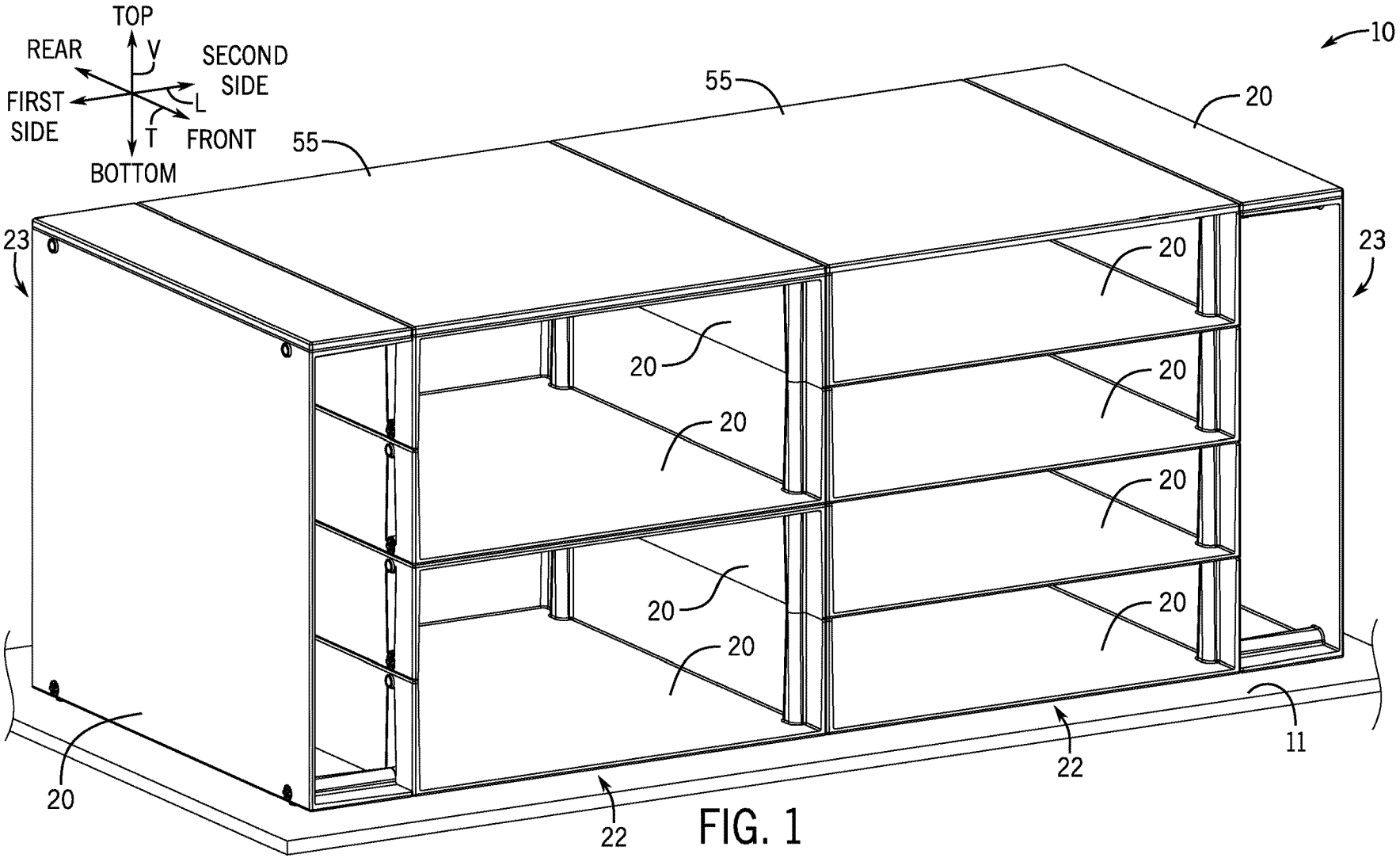
FIG. 1 is a perspective view of an example literature organizer of the present disclosure.

FIG. 1 depicts an example literature organizer 10 of the present disclosure on a support surface 11 such as a desktop. The organizer 10 is configured to contain and hold various objects. For example, the organizer 10 can hold letter, papers, folders, and/or miscellaneous office supplies. The organizer 10 can vary in shape and/or size to accommodate different objects therein. As will be described further hereinbelow, the organizer 10 includes a plurality of trays 20 that can be coupled to each other to thereby form an organizer 10 having a desired shape and/or size. For example, the trays 20 are coupled together as depicted in FIG. 1 having a first section 21 with four small slots, a second section 22 with two large slots, and a pair of third or end sections 23 that sandwich the first section 21 and the second section 22 therebetween. The organizer 10 generally extends longitudinally (see longitudinal axis L) between a first side and a second side, laterally (see lateral axis T) between a front and a rear, and vertically (see vertical axis V) between a top and a bottom (see FIG. 2). In another example, the trays 20 are vertically stacked on each other (similar to the trays 20 in the first section 21 and the second section 22 in the example described above) such that the organizer 10 vertically extends away from the support surface 11 and has a small longitudinally and/or laterally extending footprint.

As noted above, the organizer 10 includes a plurality of trays 20, and an example tray 20 is depicted in FIGS. 2-10. Note that in certain examples, the trays 20 are identical to each other, i.e. the trays 20 have identical shape and the size. FIG. 1 depicts an example organizer 10 formed from ten identical trays 20. Note that the present inventors have contemplated that in other examples the trays 20 may be dissimilar (i.e. the trays 20 that form the organizer 10 have different sizes and shapes). For instance, the large trays (e.g., the trays 20 depicted in FIG. 1) and small trays (not shown, however, the small tray could lengths and widths that are half the lengths and widths of the large trays) are coupled together to form an organizer 10.

Referring specifically to FIGS. 2-10, an example tray 20 is described therein below. The tray 20 generally extends longitudinally between a first side 31 and a second side 32, laterally between a front 33 and a rear 34, and vertically (see vertical axis V) between a top 35 and a bottom 36. The tray 20 has a base panel 37. The tray 20 also has opposing sidewalls 38A, 38B and a rear wall 39 that extend from the base panel 37 toward the top 35. The sidewalls 38A, 38B and the rear wall 39 are positioned along a perimeter 40 of the base panel 37. In other examples, the sidewalls 38A, 38B and the rear wall 39 are inset from the perimeter 40 on the base panel 37. In certain examples, the opposing sidewalls 38A, 38B, the rear wall 39, and/or the base panel 37 can include a plurality of holes or openings (not shown) defined therein such that objects in the tray 20 are viewable through the holes. The holes or openings would be spaced in a way to maintain the desired strength of the tray 20. The inclusion of such holes would reduce the material costs and the weight of the tray 20.

The top 35 is generally open and defines a top opening 41 through which objects may be moved into a slot 42 that is defined by the base panel 37, the sidewalls 38A, 38B, and the rear wall 39. The top opening 41 is partially bound or defined by top surfaces 45 of the sidewalls 38A, 38B and the rear wall 39. The front 33 also defines a second or front opening 44 through which objects may also be moved into the slot 42. The second opening 14 is partially bound or defined by front surfaces 46 of the sidewalls 38A, 38B and the base panel 37. The base panel 37, the sidewalls 38A, 38B, and the rear wall 39 have exterior surfaces 46 that face away from the slot 42 and interior surfaces 47 that face toward the slot 42.

To facilitate coupling of the tray 20 to other trays (see FIG. 1), a plurality of connectors 51, 52 are spaced apart on the tray 20. The connectors 51, 52 extend or protrude from one of the surfaces 45, 46, 47 of the tray 20, and the connectors 51, 52 are for coupling the trays 20 to each other. Namely, first connectors 51 are similar on each tray 20 of the organizer 10 (FIG. 1) and second connectors 52 are similar on each tray 20 of the organizer 10. A first connector 51 of a first tray 20 can connect to any second connector 52 of a second tray 20 (described further herein below). As such, the trays 20 can be coupled and decoupled from each other and reorganized or reconfigured relative to each other such that the size and/or shape of the organizer 10 can be changed. Note that the number of trays 20 that can be coupled to each other can vary (e.g., ten trays 20 are coupled together to form the organizer 10 depicted in FIG. 1).

Figure 2:
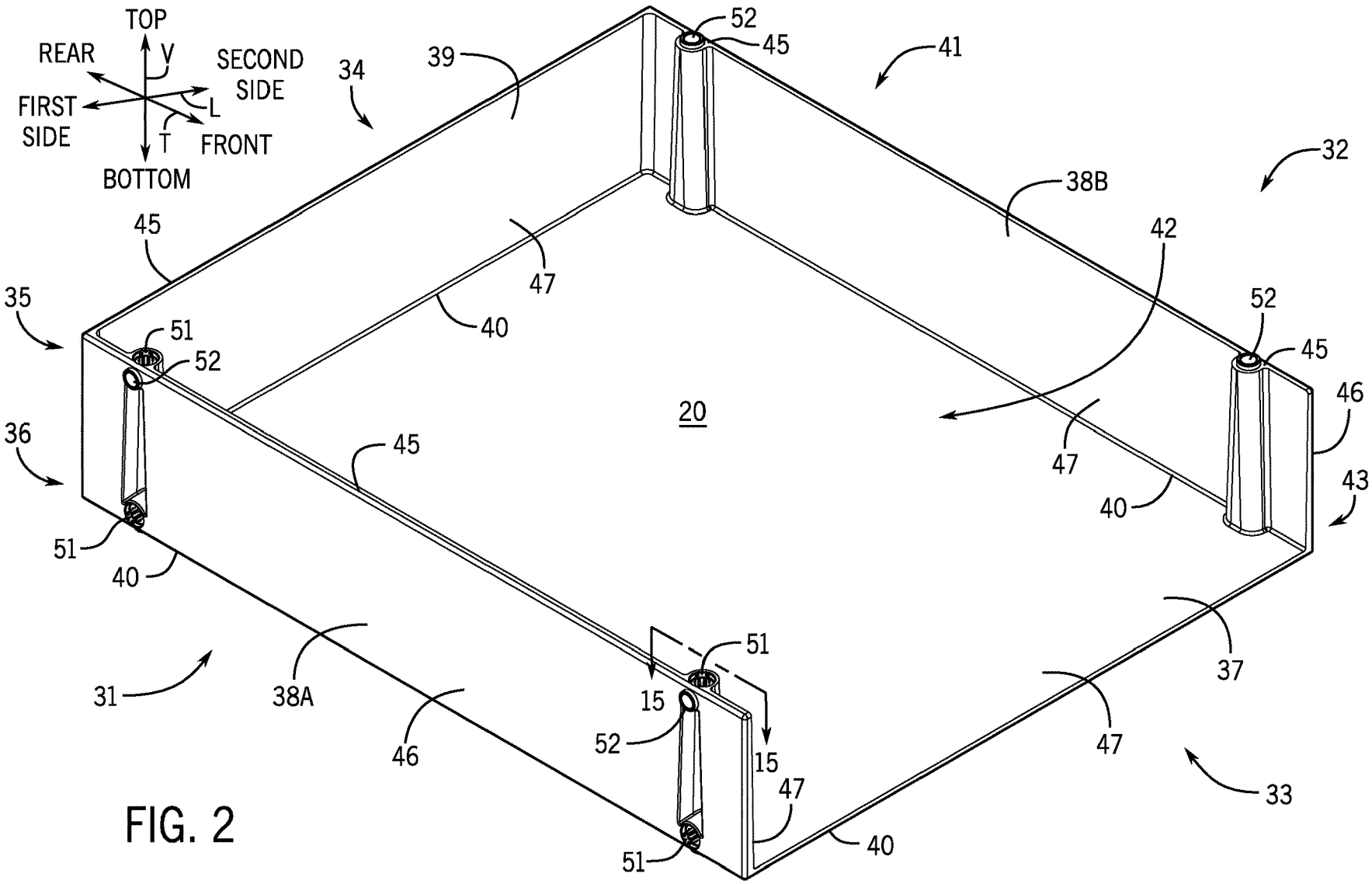
FIG. 2 is a top perspective view of an example tray of the present disclosure.
Figure 3:
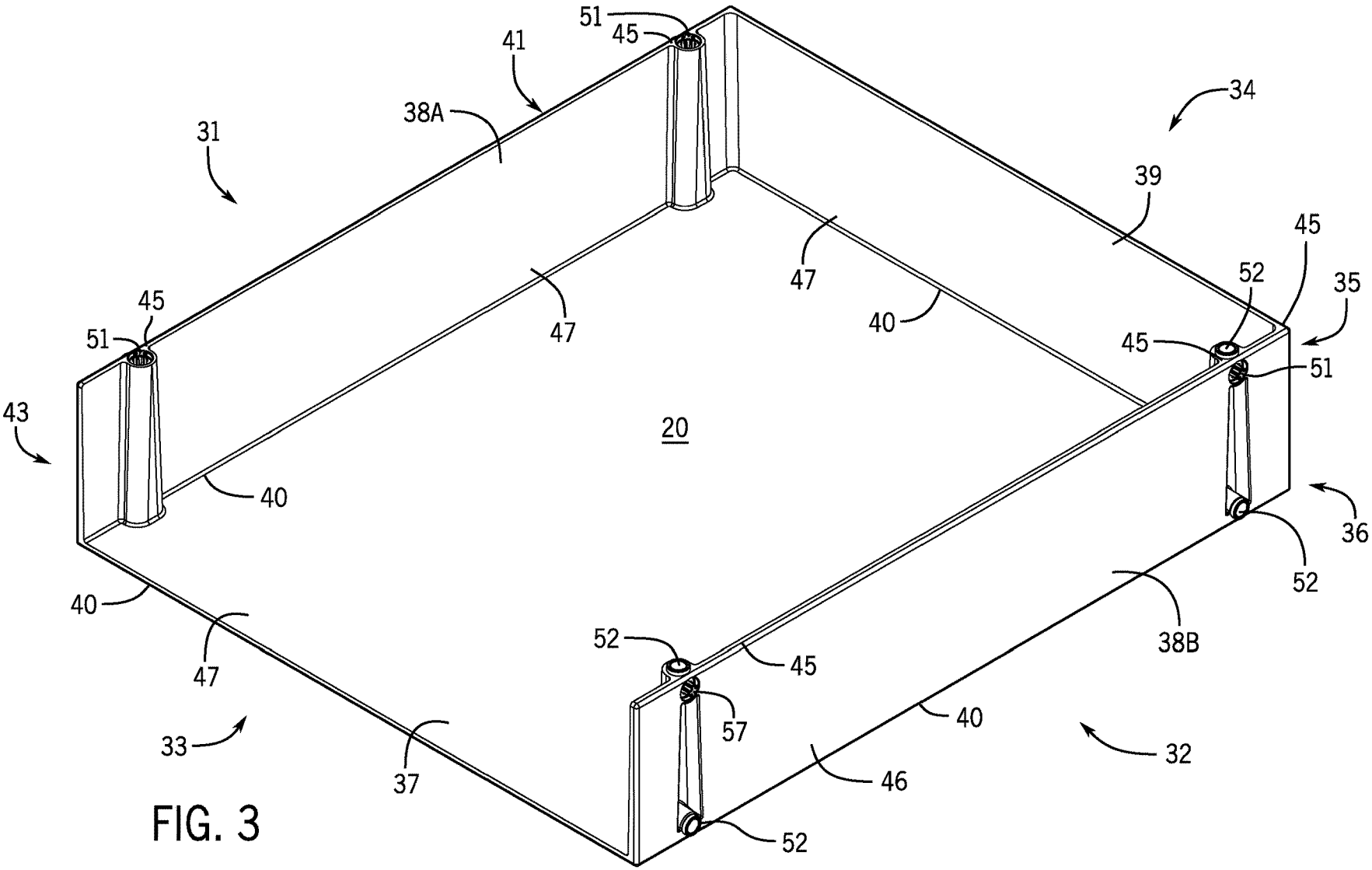
FIG. 3 is another top perspective view of the tray of FIG. 2.
Figure 4:
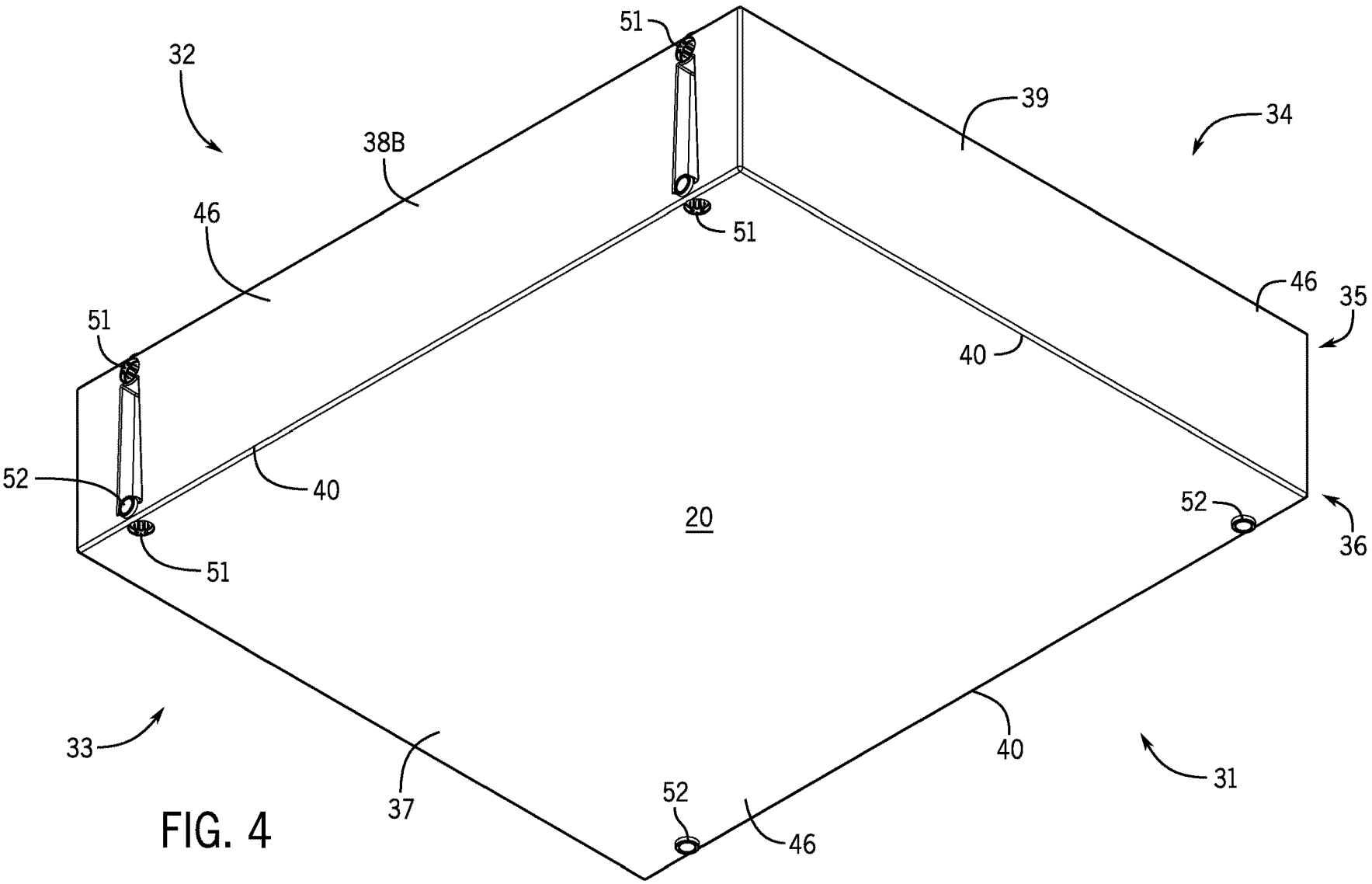
FIG. 4 is a bottom perspective view of the tray of FIG. 2.
Figure 5:
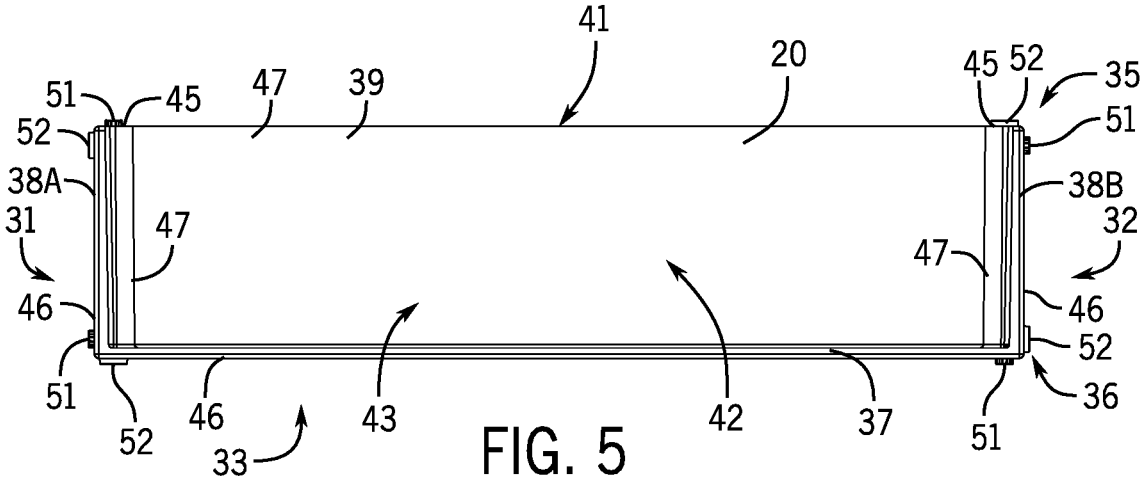
FIG. 5 is a front elevation view of the tray of FIG. 2.
Figure 6:
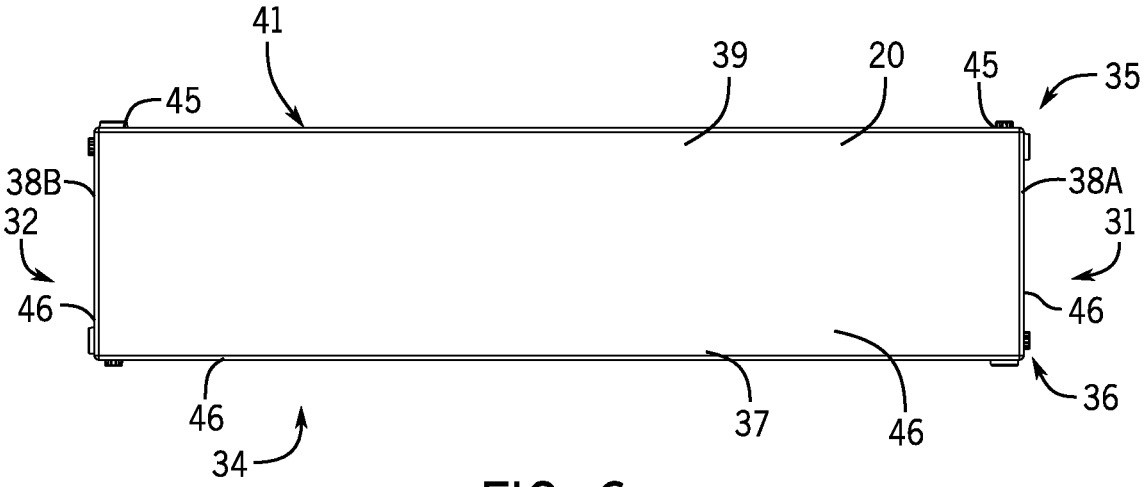
FIG. 6 is a rear elevation view of the tray of FIG. 2.
Figure 7:
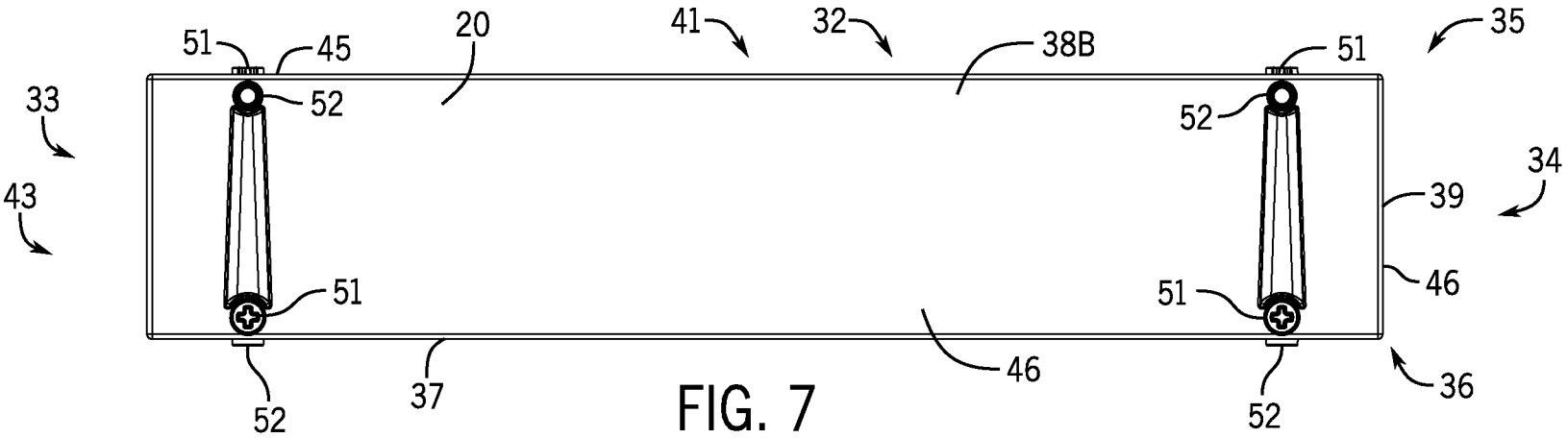
FIG. 7 is a right side elevation view of the tray of FIG. 2.
Figure 8:
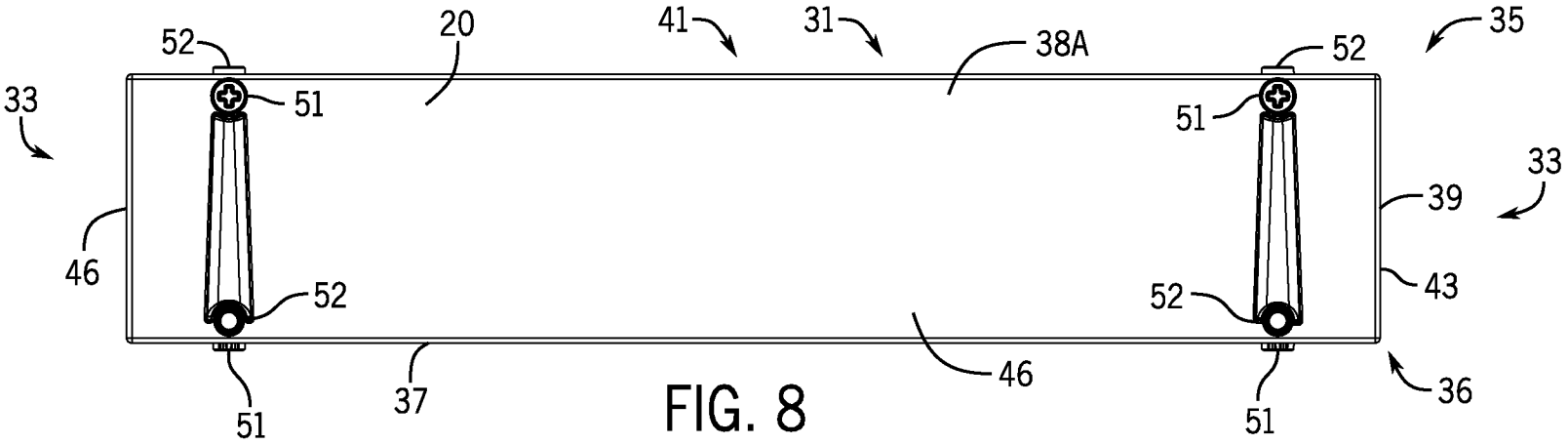
FIG. 8 is a left side elevation view of the tray of FIG. 2.
Figure 9:
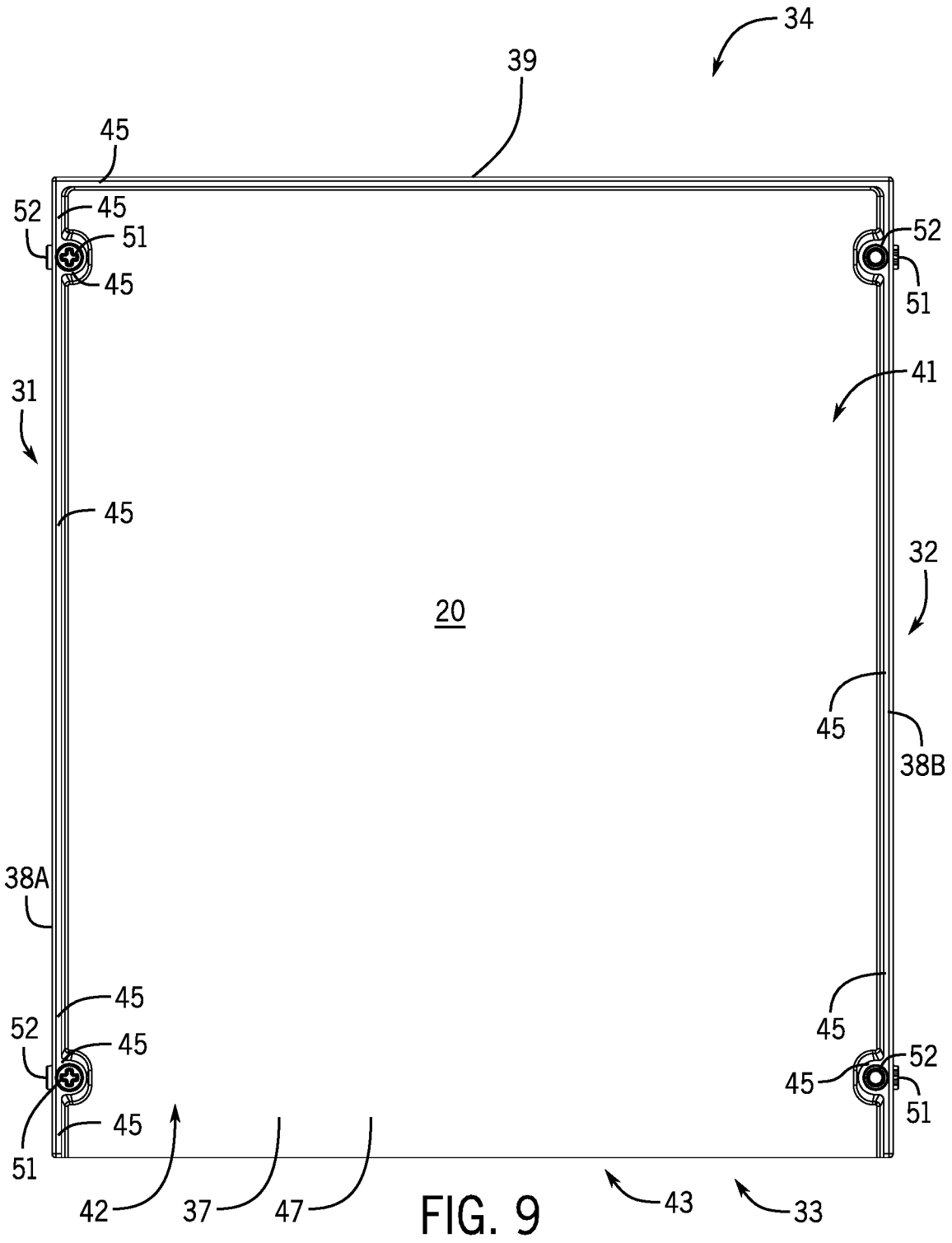
FIG. 9 is a top view of the tray of FIG. 2.
Figure 10:
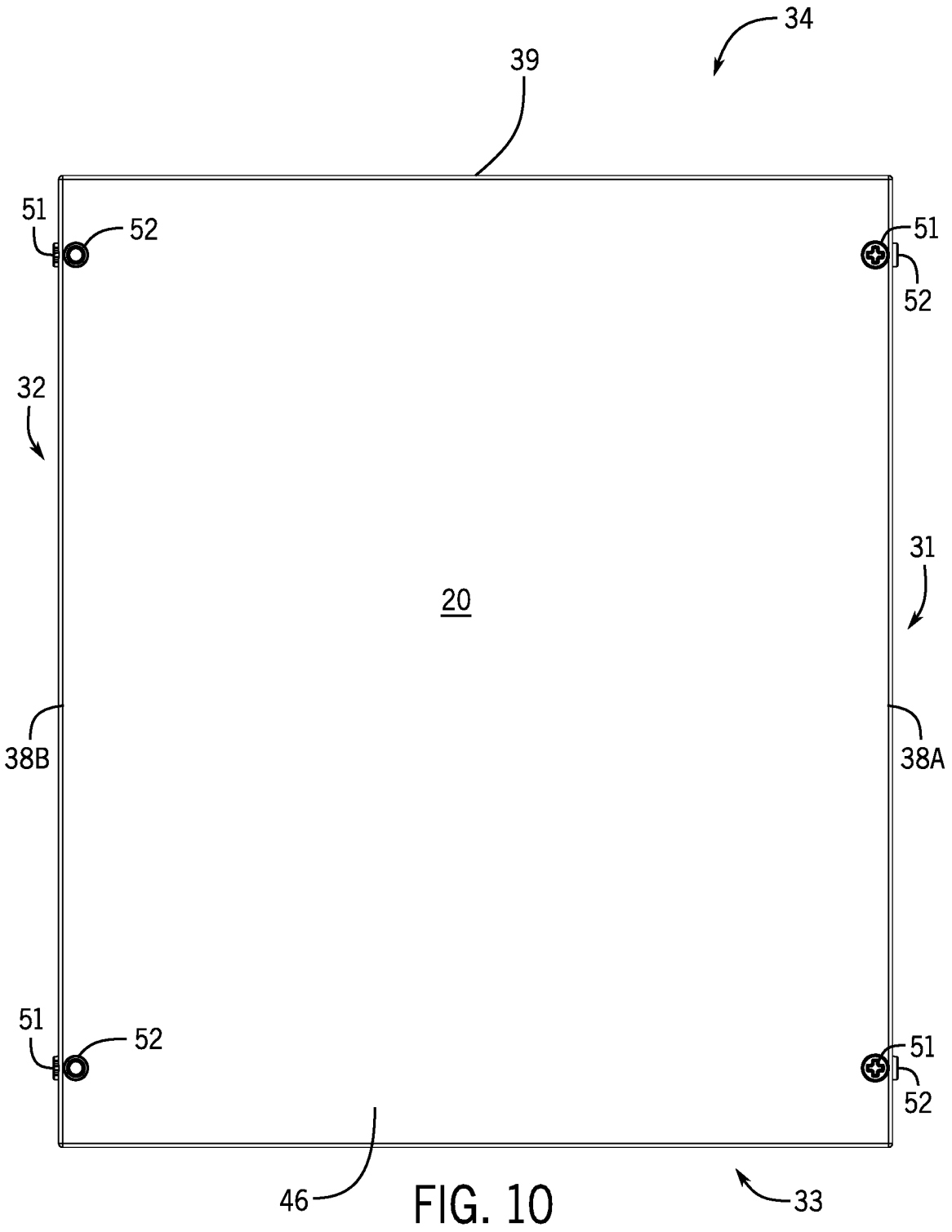
FIG. 10 is a bottom view of the tray of FIG. 2.

An example layout of the connectors 51, 52 is collectively depicted in FIGS. 2-4. The tray 20 includes two first connectors 51 spaced part along and vertically extend away from the top surface 45 of the first sidewall 38A. Two second connectors 51 are spaced apart along the opposite second sidewall 38A, and the second connectors 52 extend away the top surface 45 of the second sidewall 38B.

Figure 17:
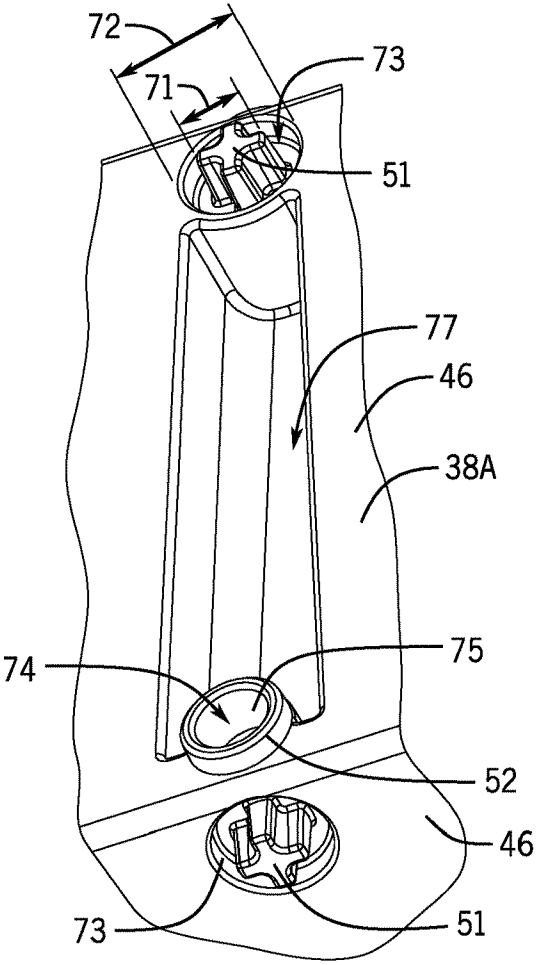
FIGS. 15-17 are enlarged views of the tray within line 15-15 on FIG. 2.
Figure 16:
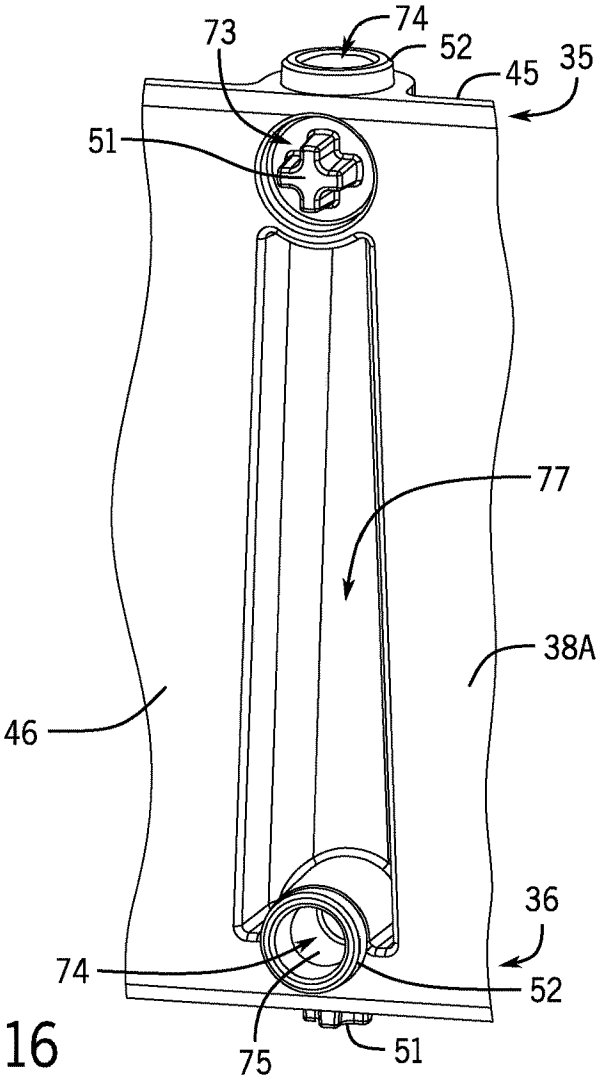
Figure 15:
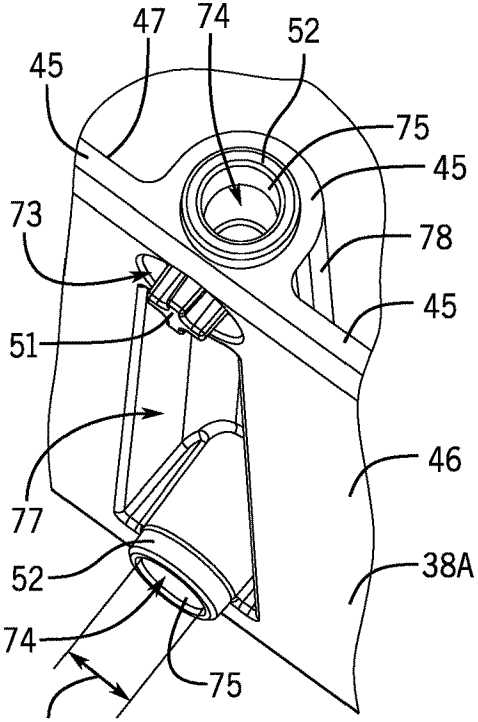

Additional connectors 51, 52 are spaced apart along the base panel 37 (see FIG. 4), and the layout of the connectors 51, 52 along the base panel 37 mirror the layout of connectors 51, 52 that extend from the top surfaces 45 of the sidewalls 38A, 38B (see FIG. 3 as described above). Specifically, two first connectors 51 are along base panel 37 near the second side 32 of the tray 20 and two second connectors 52 are along base panel 37 near the first side 31 of the tray 20. Accordingly, multiple trays 20 having the above noted layout of the connectors 51, 52 along the base panel 37 and extending from the top surfaces 45 of the sidewalls 38A, 38B can be coupled together in a stacked configuration (see FIG. 17). While in the stacked configuration, connectors 51, 52 along the base panel 37 of one of the trays 20 mate with the connectors 51, 52 that extend from the top surfaces 45 of the sidewalls 38A, 38B of another tray 20.

Figure 11:
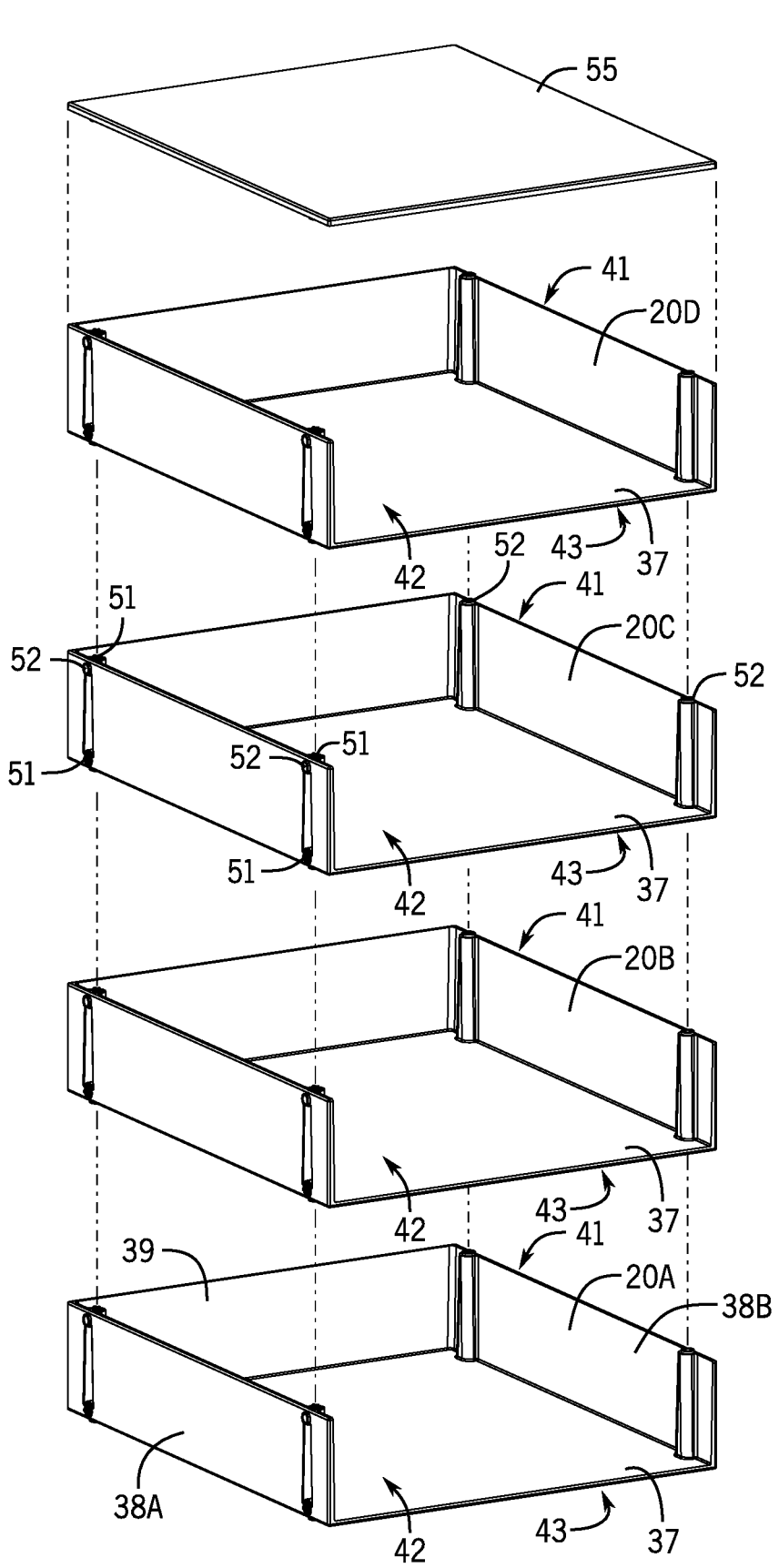
FIG. 11 is an exploded view of an example literature organizer.

Referring to FIG. 11, trays 20A-D are stacked (similar to the first section 21 of the organizer 10 depicted in FIG. 1) such that the base panel 37 of a second tray 20B closes and extends along the top opening 41 of a first tray 20A that is located immediately vertically below the first tray 20A (e.g., a stack orientation). As such, the slot 42 of the first tray 20A is only open at the front. Additional trays 20C, 20D are similarly stacked on the second tray 20B. A lid or cover 55, with connectors 51, 52 arranged in a layout similar to the layout of the connectors 51, 52 along the base panel 37 of the trays 20A-D, couples to the upppermost tray 20D to thereby close and extend along the top opening 41 of the upppermost tray 20D.

Figure 12:
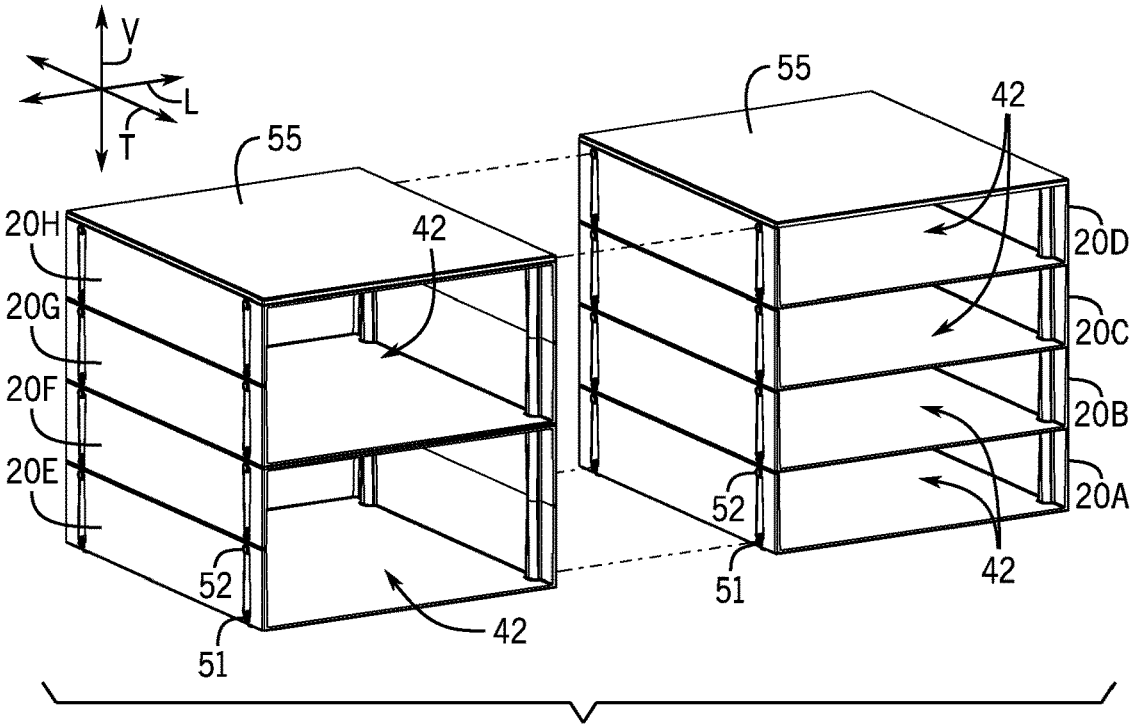
FIG. 12 is a perspective view of the literature organizer of FIG. 11 with additional trays in another stacked configuration.

Referring to FIG. 12, trays 20E-H are stacked such that top openings 41 of adjacent trays (e.g., tray 20E & tray 20F and tray 20G & 20H) face each other (similar to the second section 22 of the organizer 10 depicted in FIG. 1). Thus, in this example, adjacent stacked trays 20E-F and 20G-H are in an inverted stacked orientation in contrast to the stacked orientation noted above. Accordingly, the slots 42 of the adjacent trays 20 collectively form a larger, combined slot (in comparison to a single slot 42 alone) in which larger objects can be placed. FIG. 12 depicts a lid or cover 55 on the base panel 37 of the uppermost tray 20H that couples with the connectors 51, 52 of the uppermost tray 20H and provides a smooth upper surface above the stack of trays 20E-H.

Figure 13:
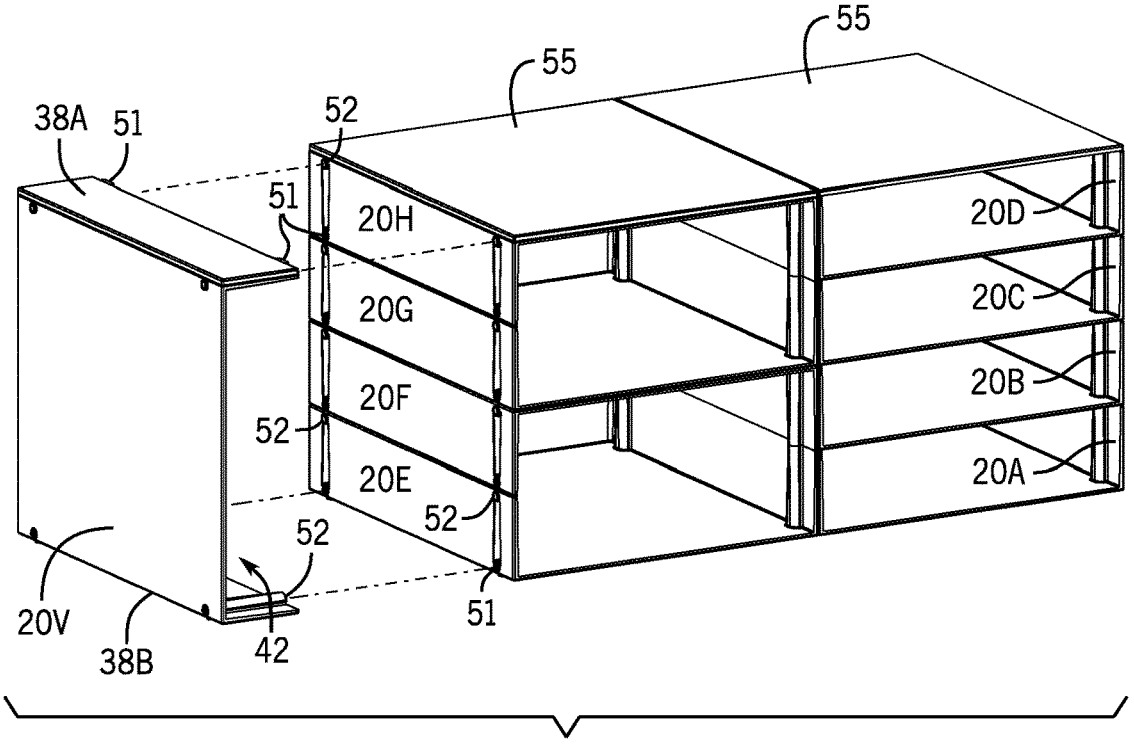
FIGS. 13-14 are perspectives view of the literature organizer of FIG. 12 with additional vertically oriented trays.

Returning to FIGS. 2-4, the tray 20 also includes first connectors 51 and second connectors along each of the opposing sidewalls 38 such that trays 20 can be coupled to each other in a side-by-side configuration (see FIGS. 12-13).

Specifically referring to FIG. 2, two first connectors 51 are spaced apart near the top the first sidewall 38A and two second connectors 52 are spaced apart near the bottom of the first sidewall 38A. The connectors 51, 52 extend or protrude from the exterior surfaces 46 of the first sidewall 38A, Note that the first connector 51 and the second connector 52 near the rear of the tray 20 are aligned with each other along a first vertical axis and that the first connector 51 and the second connector 52 near the front of the tray 20 are aligned with each other along a second vertical axis. The first connectors 51 are aligned with each other along a first laterally extending axis and the second connectors 52 are aligned with each other along a second laterally extending axis.

Now specifically referring to FIG. 3, two second connectors 52 are spaced apart near the top of the second sidewall 38B and the two first connectors 51 are spaced apart near the bottom of the second sidewall 38B. The connectors 51, 52 extend or protrude from the exterior surfaces 46 of the second sidewall 38B in a direction that is opposite the direction the connectors 51, 52 along the first sidewall 38A extend. As such, the layout of the connectors 51, 52 along the second sidewall 38B mirror the layout of the connectors 51, 52 along the first sidewall 38A. Accordingly, multiple trays 20 having the above noted layout of the connectors 51, 52 along the sidewalls 38A, 38B can be coupled together in a side-by-side configuration (see FIGS. 12-13). Specifically, the connectors 51, 52 along the first sidewall 38A of one tray 20 mate with connectors 51, 52 along the second sidewall of another tray 20.

FIG. 12 depicts the two stacks of trays 20 described above spaced apart from each other, and FIG. 13 depicts corresponding trays 20 in each stack of trays 20 coupled together such that the two stacks of trays 20 are coupled together. Note that the connectors 51, 52 are arranged on the tray 20 such that upside-down or inverted trays 20 (see two trays of the leftmost stack in FIG. 12) can couple to the adjacent trays 20 via the connectors 51, 52.

Figure 14:
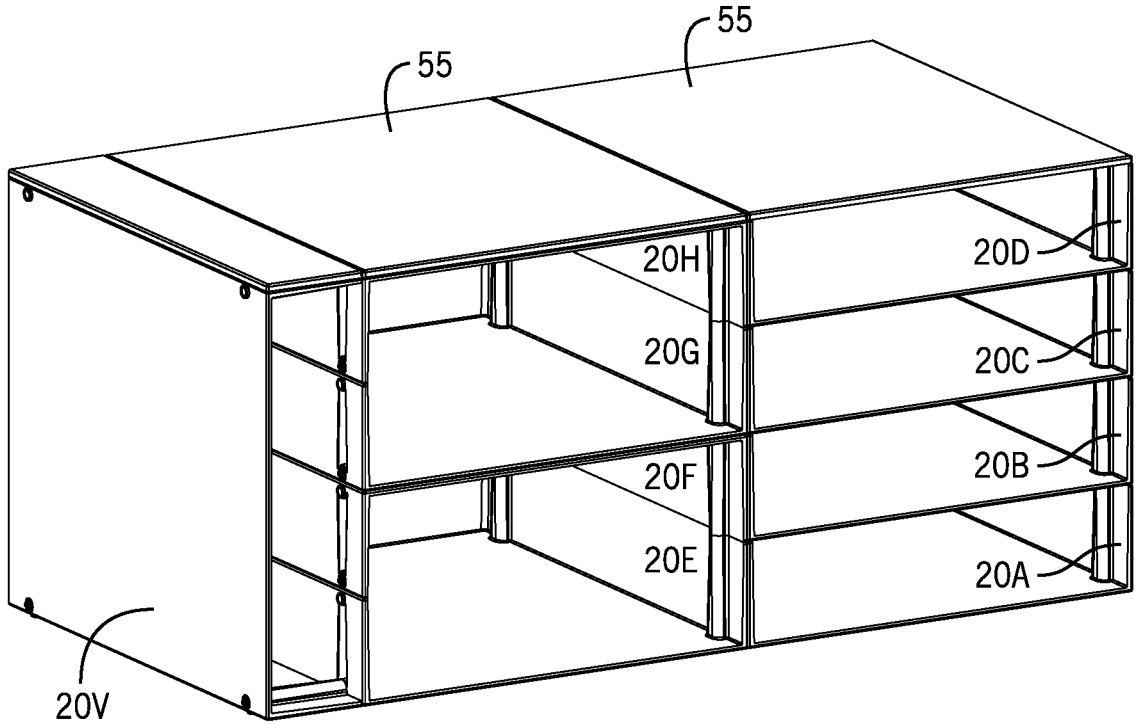

In addition, the layout of the connectors 51, 52 on the sidewalls 38A, 38B permit a tray 20V to be vertically oriented (such that the sidewalls 38A, 38B are vertically spaced apart from each other, see tray 20V) and coupled to one or more sidewalls that are laterally or longitudinally oriented (such as the trays 20 in the two stacks of trays depicted in FIG. 13-14). Note that the vertically oriented trays 20V are similar to the third section 23 of the organizer 10 depicted in FIG. 1. Accordingly, the trays 20V can be coupled to the sidewalls 38A, 38B of vertically stacked trays 20, as depicted in FIG. 14. A person of ordinary skill in the art will recognize that additional vertically oriented trays 20V can be couple to each other to create a "sideway stacked" arrangement trays 20V such that the slots of the trays 20V are vertically oriented.

Referring now to FIGS. 15-20, the connectors 51, 52 are depicted in greater detail. The first connector 51 extends away from the sidewall 38A, 38B or the base panel 37 as noted above. The shape and/or size of the first connector 51 can vary, and the example first connector 51 depicted in FIGS. 15-20 is generally "t"-shaped. The first connector 51 has a first width 71 (see FIG. 17) extending between the extents of two legs of the first connector 51. Note that sidewall 38A, 38B or the base panel 37 can include a recess 73 in which the first connector 51 is positioned. The recess 73 has a width or a diameter 72 that is greater then the width 71 of the connector 51.

The second connector 52 also extends away from the sidewall 38A, 38B or the base panel 37 as noted above. The shape and/or the size of the second connector 52 can vary, and the example second connector 52 depicted in FIGS. 15-20 is generally circular with a center bore 74 defined by an interior surface 75. The width or diameter 76 of the center bore 74 is equal to or slightly less than the width 71 of the first connector 51 such that the first connector 51 can be received into the center bore 74 and fictionally engage the second connector 52 (e.g., the connectors 51, 52 frictionally engaged each other). Note that in certain examples, the first connector 51 tapers in a direction from the sidewall 38A, 38B or the base panel 37 toward the free end of the first connector 51 (e.g., the width of the first connector 51 at the fixed end coupled to the sidewall 38A, 38B or the base panel 37 is greater than the width of the first connector 51 at the free end). In other examples, the bore 74 of the second connector 52 tapers in a direction from the free end of the second connector 52 to the fixed end coupled to the sidewall 38A, 38B or the base panel 37 (e.g., the width of the bore 74 at the end coupled to the sidewall 38A, 38B or the base panel 37 is less than the width of the bore 74 at the free end).

Figure 18:
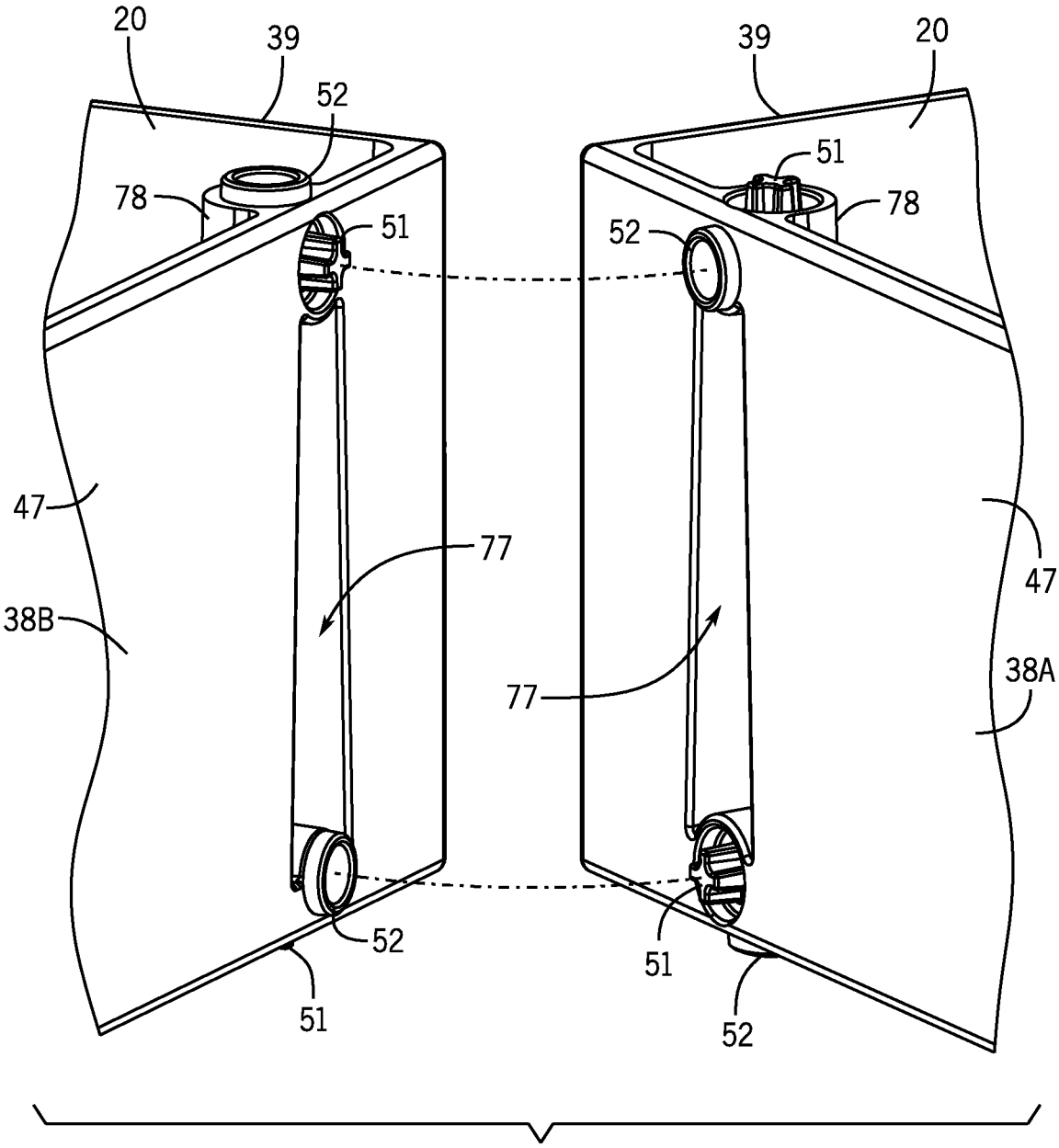
FIG. 18 is a perspective view of a first example tray adjacent to a second example tray.
Figure 19:
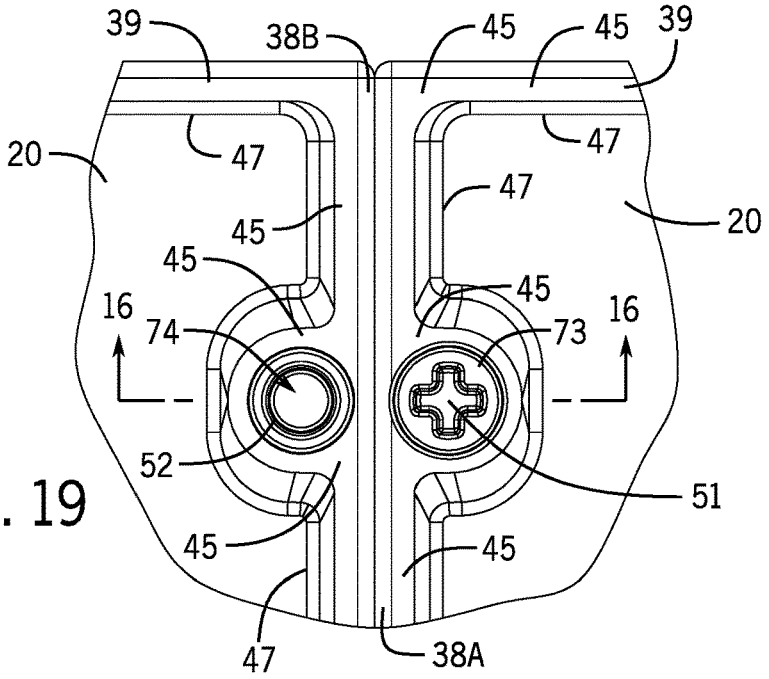
FIG. 19 is a top-down plan view of a first example tray coupled to a second example tray.
Figure 20:
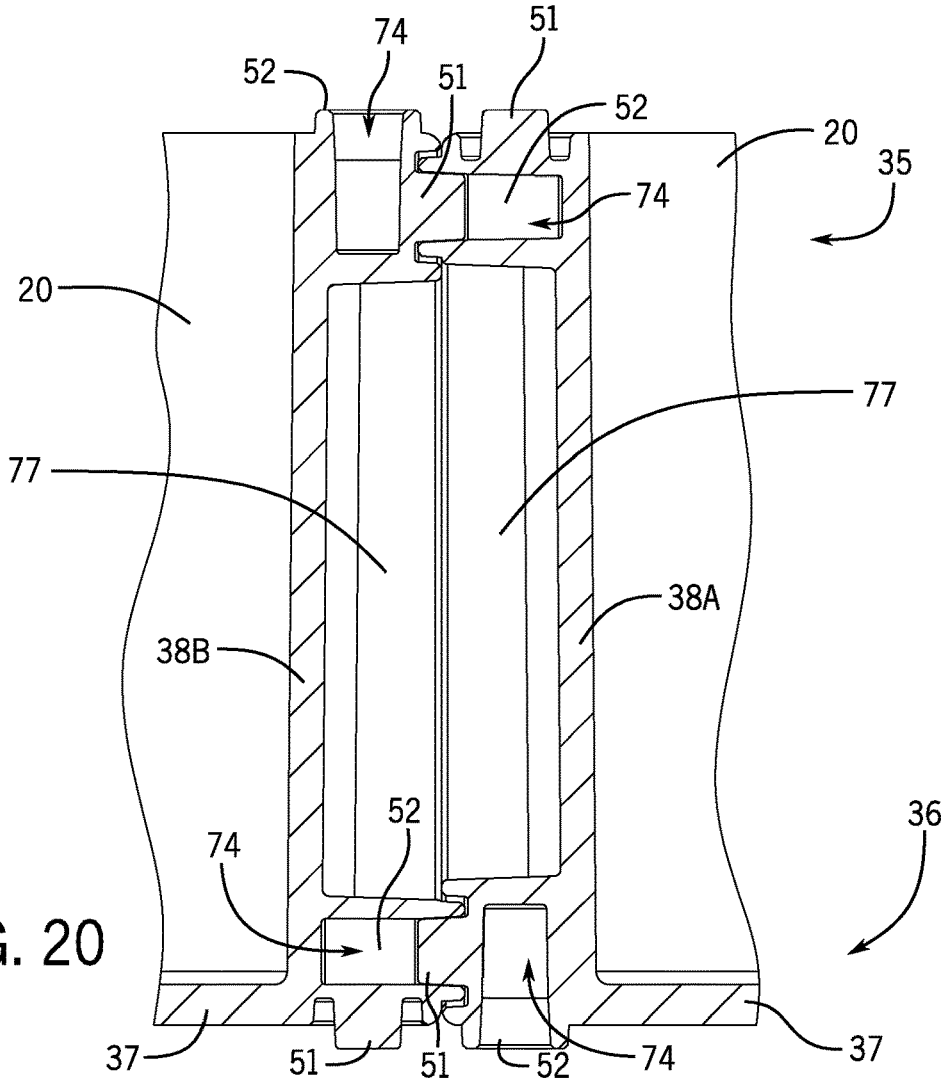
FIG. 20 is a cross-sectional view of the example trays along

FIGS. 18-20 depict example connectors 51, 52 of two trays 20 coupled to each other. As noted above, the first connectors 51 are received into the bore 74 of the second connectors 52, and accordingly, the exterior surface of the first connectors 51 contacts the interior surface 75 of the second connector 52 thereby creating friction therebetween which prevents the connectors 51, 52 from inadvertently decoupling from one another. Note that the free end of the second connector 52 is also received into the recess 73 around the first connector 51. In certain examples in which the first connectors 51 and/or the second connectors 52 are tapered (see examples describe above), the friction between the exterior surface of the first connector 51 and the interior surface 75 of the second connector 52 increases as the first connector 51 it moved into the bore 74 of the second connector 52. These features increase the friction between the connectors 51, 52 and further prevent the connectors 51, 52 from inadvertently decoupling from each other. Note that FIGS. 18-20 depict a channel 77 in the sidewall 38A, 38B between the connectors 51, 52 along the sidewall 38A, 38B. This channel 77, and the corresponding projection 78 that extends into the slot 42, reinforces and stiffens the sidewalls 38A, 38B. Note in certain examples the interior surface 47 of the sidewall 38A, 38B extends along the projection 78.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An organizer comprising:

a first tray having a plurality of first connectors, a plurality of second connectors, a top, a bottom, and a pair of opposing sides, wherein the opposing sides are defined by a first sidewall and an opposing second sidewall, wherein two first connectors of the plurality of first connectors are spaced apart along the first sidewall and extend away from a top surface of the first sidewall and two second connectors of the plurality of second connectors are spaced apart along the second sidewall and extend away from a top surface of the second sidewall, wherein two first connectors of the plurality of first connectors are spaced apart along a bottom of the first sidewall and extend away from an exterior surface of the first sidewall;

wherein two second connectors of the plurality of second connectors are spaced apart along a top of the first sidewall and extend away from the exterior surface of the first sidewall;

wherein two first connectors of the plurality of first connectors are spaced apart along a top of the second sidewall and extend away from an exterior surface of the second sidewall;

wherein two second connectors of the plurality of second connectors are spaced apart along a bottom of the second sidewall and extend away from the exterior surface of the second sidewall;

a second tray with a plurality of first connectors and a plurality of second connectors;

wherein one first connector of the plurality of first connectors of the second tray is mated with one second connector of the plurality of the second connectors of the first tray and one second connector of the plurality of second connectors of the second tray is mated with one first connector of the plurality of the first connectors of the first tray to thereby couple the second tray to one of the top, the bottom, or one side of the opposing sides.

2. The organizer according to claim 1, wherein the second tray is identical to the first tray.

3. The organizer according to claim 1, wherein one first connector of the plurality of first connectors of the first tray extends from each of the top, the bottom, and each side of the opposing sides.

4. The organizer according to claim 3, wherein one second connector of the plurality of second connectors of the first tray extends from each of the top, the bottom, and each side of the opposing sides.

5. The organizer according to claim 1, wherein the top of the first tray is open such that that a bottom of the second tray closes the top of the first tray or an open top of the second tray is along the top of the first tray.

6. The organizer according to claim 5, wherein the first tray has a slot and the second tray has a slot, and wherein when the open top of the second tray is along the top of the first tray, the slot of the first tray and the slot of the second tray collectively form a combined slot that is larger than the one of the slots alone.

7. An organizer comprising:

a first tray having a plurality of first connectors, a plurality of second connectors, a top, a bottom, and a pair of opposing sides, wherein the opposing sides are defined by a first sidewall and an opposing second sidewall, wherein two first connectors of the plurality of first connectors are spaced apart along the first sidewall and extend away from a top surface of the first sidewall and two second connectors of the plurality of second connectors are spaced apart along the second sidewall and extend away from a top surface of the second sidewall;

a second tray with a plurality of first connectors and a plurality of second connectors;

wherein one first connector of the plurality of first connectors of the second tray is mated with one second connector of the plurality of the second connectors of the first tray and one second connector of the plurality of second connectors of the second tray is mated with one first connector of the plurality of the first connectors of the first tray to thereby couple the second tray to one of the top, the bottom, or one side of the opposing sides;

wherein the bottom of the first tray is defined by a base panel;

wherein two first connectors of the plurality of first connectors are spaced apart along the base panel near the second side of the tray; and wherein the two second connectors of the plurality of second connectors are spaced apart along the base panel near the first side of the tray.

8. The organizer according to claim 1, wherein the bottom of the first tray is defined by a base panel;

wherein each first connector of the plurality of first connectors extends out of a recess defined in one of the base panel, the first sidewall, or the second sidewall.

9. The organizer according to claim 8, wherein at least one second connector of the plurality of second connectors is received into one of the recesses when the second tray is coupled to the first tray.

10. The organizer according to claim 9, wherein the at least one second connector has a bore in which one first connector of the plurality of first connectors is received when the second tray is coupled to the first tray.

11. The organizer according to claim 10, wherein the at least one second connector frictionally engages one first connector of the plurality of first connectors when the second tray is coupled to the first tray.

12. The organizer according to claim 1, wherein the one first connector frictionally engages the one second connector.

13. The organizer according to claim 12, wherein the one first connector is tapered.

14. The organizer according to claim 13, wherein the one second connector is tapered.

15. The organizer according to claim 1, wherein the second tray is coupled to the first tray, the second tray is oriented in a vertical direction while the first tray is oriented in a longitudinal direction.

16. An organizer comprising:

a first tray having:

a first sidewall that defines a first side of the tray and has a pair of first connectors extending from a top surface, wherein the first sidewall of the first tray has a pair of first connectors and a pair of second connectors extending from an exterior surface of the first sidewall;

a second sidewall that defines a second side of the tray and has a pair of second connectors extending from a top surface;

a base panel extending between the first sidewall and the second sidewall, the base panel has a pair of second connectors near the first side of the first tray and a pair of first connectors near the second side of the first tray that extend from an exterior surface; and a second tray having:

a first sidewall that defines a first side of the second tray and has a pair of first connectors extending from a top surface, wherein the first sidewall of the second tray has a pair of first connectors and a pair of second connectors extending from an exterior surface of the first sidewall;

a second sidewall that defines a second side of the second tray and has a pair of second connectors extending from a top surface;

a base panel extending between the first sidewall and the second sidewall, the base panel has a pair of second connectors near the first side of the second tray and a pair of first connectors near the second side of the second tray that extend from an exterior surface; and a third tray having:

a first sidewall that defines a first side of the third tray and has a pair of first connectors extending from a top surface; and a second sidewall that defines a second side of the third tray and has a pair of second connectors extending from a top surface;

wherein the first connectors of the base panel of the second tray engage the second connectors of the second sidewall of the first tray and the second connectors of the base panel of the second tray engage the first connectors of the first sidewall of the first tray to thereby couple the second tray to the first tray in a stacked orientation; and wherein the first connectors along the first sidewall of the third tray engage with the second connectors along the first sidewall of the second tray and wherein the second connectors along the second sidewall of the third tray engage the first connectors along the first sidewall of the first tray to thereby couple the third tray to the first tray and to the second tray such that the third tray is vertically oriented.

17. The organizer according to claim 16, wherein the first connectors of the first sidewall of the second tray engage with the second connectors of the second sidewall of the first tray and the second connectors of the second sidewall of the second tray engage the first connectors of the first sidewall of the first tray to thereby couple the second tray to the first tray in an inverted stacked orientation.

* * * * *